US006402478B1

(12) United States Patent
Zhang et al.

(10) Patent No.: US 6,402,478 B1
(45) Date of Patent: Jun. 11, 2002

(54) SOLD OUT SENSING DEVICE AND METHOD

(76) Inventors: Ming Zhang, 2758 Olentangy Dr., Akron, OH (US) 44333; Joseph W. Shannon, 7532 Diagonal Rd., Kent, OH (US) 44240

( * ) Notice: Subject to any disclaimer, the term of this patent is extended or adjusted under 35 U.S.C. 154(b) by 0 days.

(21) Appl. No.: 09/519,514

(22) Filed: Mar. 6, 2000

(51) Int. Cl.[7] ..... B67D 5/22
(52) U.S. Cl. ..... 417/63; 222/23
(58) Field of Search ..... 222/66; 417/36, 417/44.11, 63

(56) References Cited

U.S. PATENT DOCUMENTS 4,583,916 A * 4/1986 Senghaas et al. ..... 417/36
5,015,151 A * 5/1991 Snyder et al. ..... 417/44.11
5,318,409 A * 6/1994 London et al. ..... 417/63
5,601,413 A * 2/1997 Langley et al. ..... 417/44.11
6,053,361 A * 4/2000 Hills ..... 417/36

* cited by examiner

*Primary Examiner*—Michael Koczo

(74) *Attorney, Agent, or Firm*—Sten Eric Hakanson

(57) ABSTRACT

A control for a beverage dispenser monitors operation thereof to sense a beverage sold out condition. The control senses the voltage demand of a pump motor as it pumps the beverage from a source thereof to a dispensing valve. If the sensed voltage is high, that indicates the pump is encountering resistance and fluid is present. Conversely, if the sensed voltage use is low, that is taken to indicate that the pump is not pumping any liquid and that the container is empty. A software routine is used to sense the average current requirements during dispensing and adjust the reference voltage for the normal full reservoir pump current value based on a historical average thereof as indicated by a predetermined number of prior dispense cycles. The control uses the adjusted reference voltage as a base for determining a sold out condition. Thus, the control of the present invention has the ability to learn over time and to compensate for physical changes in hardware and in the environment to provide for accurate sold-out determinations. The control senses an sold out condition in one of two ways. If the control senses a large variation between voltage samplings during a dispense cycle, that is taken to indicate a situation where the syrup or beverage is running out. If there is no significant difference between the sensed voltages, but the sensed voltage is significantly below the reference voltage that would be expected if fluid were present, that also indicates a sold out condition.

2 Claims, 5 Drawing Sheets

MICRO CONTROLLER + MEMORY CIRCUIT
INTERFACE CIRCUIT
35
55
U1
U2
VDD
INT
A0
A1
A2
A3
CLK
LR
C1
C2
VSS
VCC
NC
NC
GND
CS
CLK
Q1B
J1
LED1
R23
R16
R15
Q2
P3
R14
R21
R18
R19
Y1
36V
5V
F
C
D
E

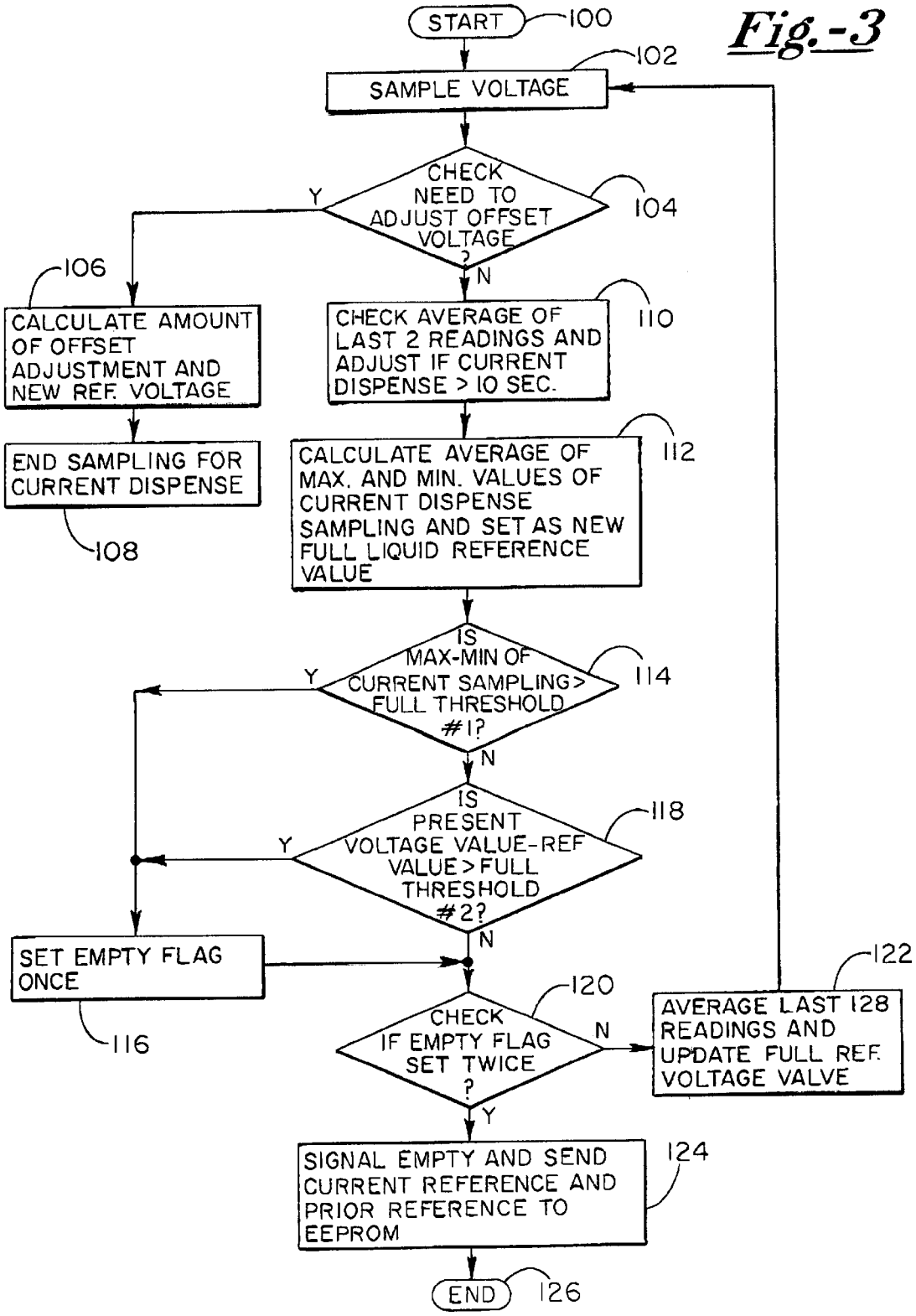
Fig.-3
START
100
SAMPLE VOLTAGE
102
CHECK NEED TO ADJUST OFFSET VOLTAGE ?
104
Y
N
CALCULATE AMOUNT OF OFFSET ADJUSTMENT AND NEW REF. VOLTAGE
106
END SAMPLING FOR CURRENT DISPENSE
108
CHECK AVERAGE OF LAST 2 READINGS AND ADJUST IF CURRENT DISPENSE > 10 SEC.
110
CALCULATE AVERAGE OF MAX. AND MIN. VALUES OF CURRENT DISPENSE SAMPLING AND SET AS NEW FULL LIQUID REFERENCE VALUE
112
IS MAX-MIN OF CURRENT SAMPLING > FULL THRESHOLD #1?
114
Y
N
IS PRESENT VOLTAGE VALUE-REF VALUE > FULL THRESHOLD #2?
118
Y
N
SET EMPTY FLAG ONCE
116
CHECK IF EMPTY FLAG SET TWICE ?
120
N
Y
AVERAGE LAST 128 READINGS AND UPDATE FULL REF. VOLTAGE VALVE
122
SIGNAL EMPTY AND SEND CURRENT REFERENCE AND PRIOR REFERENCE TO EEPROM
124
END
126

SOLD OUT SENSING DEVICE AND METHOD

FIELD OF THE INVENTION

The present invention relates generally to beverage dispensing equipment, and in particular to beverage or syrup sold out sensing systems therefor.

BACKGROUND OF THE INVENTION

Beverages are dispensed generally either in a pre-mix form, wherein plain or carbonated water and syrup have been previously combined in the desired ratio to form a finished drink, or in a post-mix form wherein the water and syrup are combined in an on-demand basis at the point of dispense. The pre-mix drink, or the syrup in the case of post-mix, can be retained in, for example, a stainless steel tank or bag-in-box container. The container can then be fluidly connected to a dispenser for the delivery of the drink or syrup thereto. A continuing problem involves sensing when the reservoir of beverage or syrup is empty so that an appropriate sold-out signal can be generated indicating that the empty container should be changed out for a new one.

One existing system looks at the current demand of the solenoid of the dispensing valve of such dispensers. If the current demand is high, i.e. the solenoid is opening against a pressure force, then it is interpreted that there is sufficient beverage. If the current draw is low, then that indicates that the valve is encountering no resistance to open, which is interpreted as no beverage being present. This system works well but is limited to solenoid operated valves. Other systems use fluid conductivity sensors to sense the presence of beverage or syrup as it flows through a delivery line to the dispense valve. However, such an approach presents problems with respect to cleaning the sensors to insure that they work properly. Also, such sensors must be sanitized when changing out to a new container of beverage or syrup. Sensors are also known to determine the fluid level in a container with the use of reflection of a light signal, such as infrared, or to determine volume by weight change in weight of the container as it empties. While such sensing approaches will work, they also can present sanitation concerns as well as reliability and accuracy problems.

Accordingly, it would be desirable to have a sold-out sensing system that is reliable, accurate and that does not contact the fluid being sensed.

SUMMARY OF THE INVENTION

The present invention is a sold out system and method for use with any container of liquid or the like that is emptied by use of a pump. The pump can be of any electric motor driven variety such as, peristaltic, diaphragm, or piston. A microprocessor based control circuit includes a current sensing circuit for determining a voltage value which correlates proportionally with the current demand of the motor driving the pump. If the sensed voltage is high, that indicates the pump is encountering resistance and fluid is present. Conversely, if the sensed voltage use is low, that is taken to indicate that the pump is not pumping any liquid and that the container is empty.

In particular, the control senses an actual sold out condition in one of two ways. First, if the control senses a large variation between voltage samplings during a dispense cycle, that is taken to indicate a situation where the syrup or beverage is running out, i.e. the pump is moving a non-continuous stream of product. It can be very useful to signal a sold out condition before all of the beverage is dispensed from the container, as a discontinuous stream can result in an undesirable "sputtering" performance, and can throw off the proper ratio in the case of a post-mix dispensing. Secondly, if there is no significant difference between the sensed voltages, but the sensed voltage is significantly below the reference voltage that would be expected if fluid were present, that situation indicates that the reservoir of product is totally empty. Thus, for example, where a fairly continuous dispense has occurred to the point where essentially all the beverage has been removed from the container, such a sold out condition must also be sensed and indicated.

An important aspect of the present invention is to monitor the voltage levels during dispensing and to adjust for changes in the reference voltage value that can occur over time. It was found that the initial reference value would become inaccurate over time or with changes in ambient conditions. For example, it was found that a new pump, and especially one with a gear case, would demand more current to be operated when new than after it had been used and "broken-in". Thus, as the pump becomes easier to operate the voltage difference between the initially programmed high value and a sold out value decreases over time, i.e. there is a downward drift in the voltage requirement of the motor independent of the liquid being pumped. Changes in many other values, such as, the tubing employed through which the liquid is pumped, or ambient temperature could affect the effort needed to pump the liquid. In the case of temperature, the fluid could become more or less viscous thereby increasing or decreasing, respectively, the voltage requirements. As a result thereof, an actual sold out condition may not be sensed or in the reverse, a sold out condition could be indicated where none exists.

The present invention uses a software routine to sense the average current requirements during dispensing and adjust the reference voltage for the normal full reservoir pump current value based on a historical average thereof as indicated by a predetermined number of prior dispense cycles. The control uses the adjusted reference voltage as a base for determining a sold out condition. Thus, the control of the present invention has the ability to "learn" over time and to compensate for physical changes in hardware and in the environment to provide for accurate sold-out determinations.

DESCRIPTION OF THE DRAWINGS

A further understanding of the structure, function, operation, and objects and advantages of the present invention can be had by referring to the following detailed description which refers to the following figures, wherein:

FIG. 3 shows a flow diagram of the operational control of the present invention.

DETAILED DESCRIPTION OF THE PREFERRED EMBODIMENT

Figure 1:
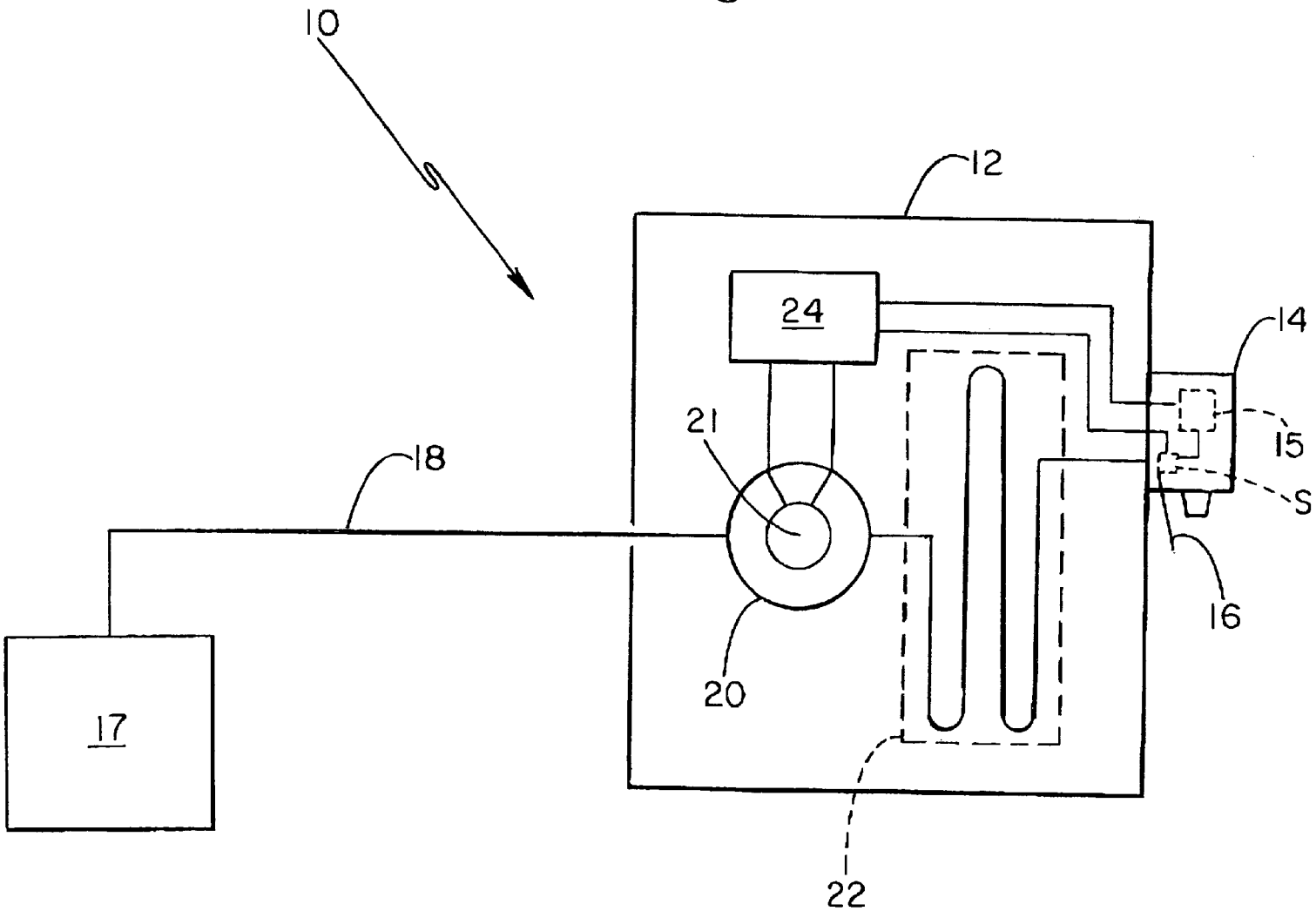
FIG. 1 shows a schematic representation of a beverage dispenser.

A schematic of a beverage dispenser wherein the control of the present invention has application, is seen in FIG. 1, and generally referred to by the numeral 10. A Beverage dispenser 12 includes one or more beverage dispensing valves 14 secured thereto. Valve 14 can be of the post-mix type wherein a syrup is mixed with a diluent, such as plain or carbonated water, or can be designed to dispense a single pre-mix finished beverage. A solenoid 15 serves to open or close valve 14. Solenoid 15 is controlled by a switch S that is actuated, for example, by a lever arm 16. A source of finished beverage or syrup concentrate 17, such as contained in a bag-in-box or a rigid container, is connected by a tube 18 to a pump 20. Pump 20, as driven by electric motor 21, serves to pump the contents of source 17 to valve 14 and provide for the motive or dispensing force thereof. A heat exchanger 22 can be interposed to provide for cooling of the syrup or beverage as it flows there through within tube 18.

Figure 2A:
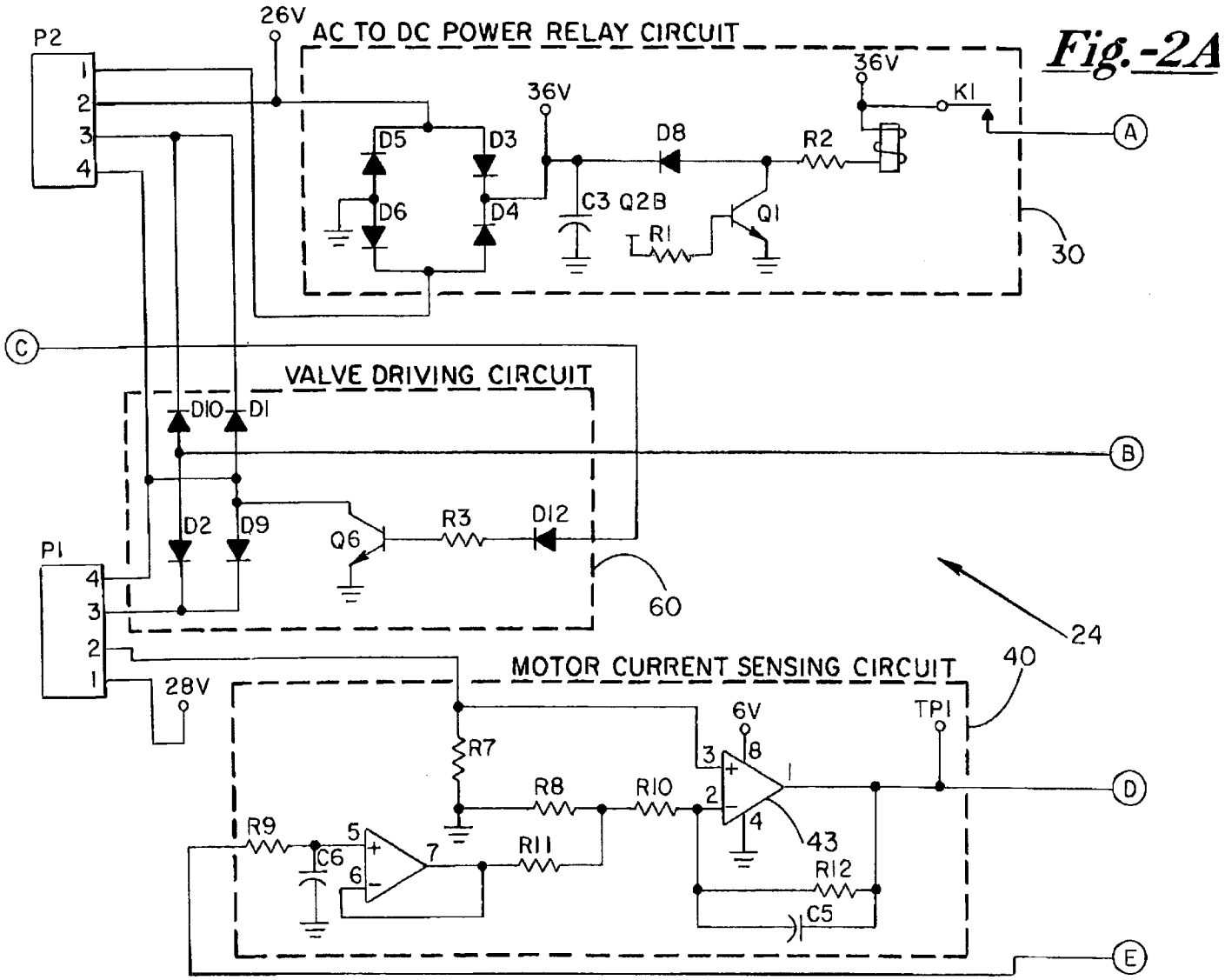
FIGS. 2A, 2B and 2C show an electrical schematic of the control of the present invention.
Figure 2B:
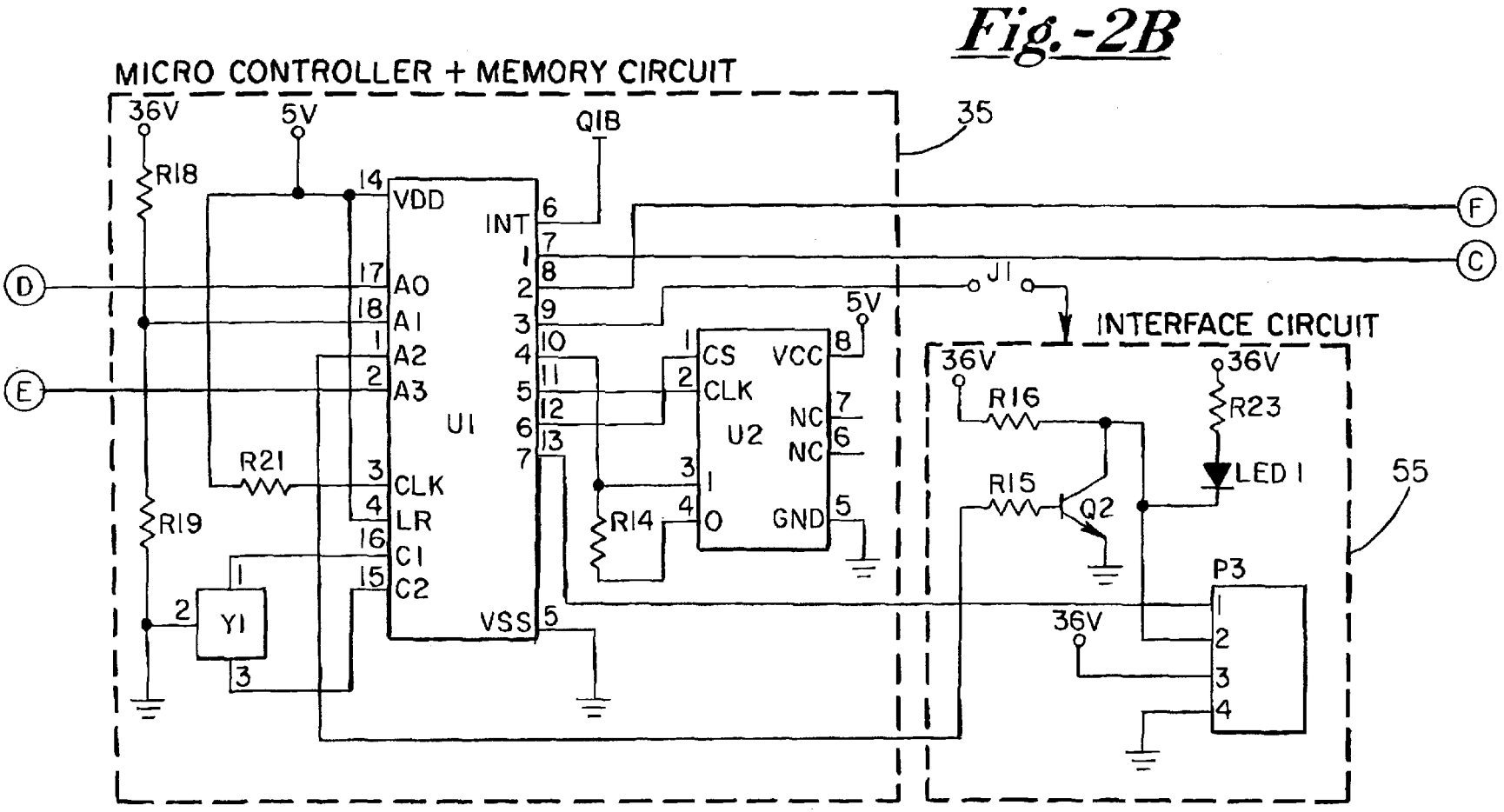
Figure 2C:
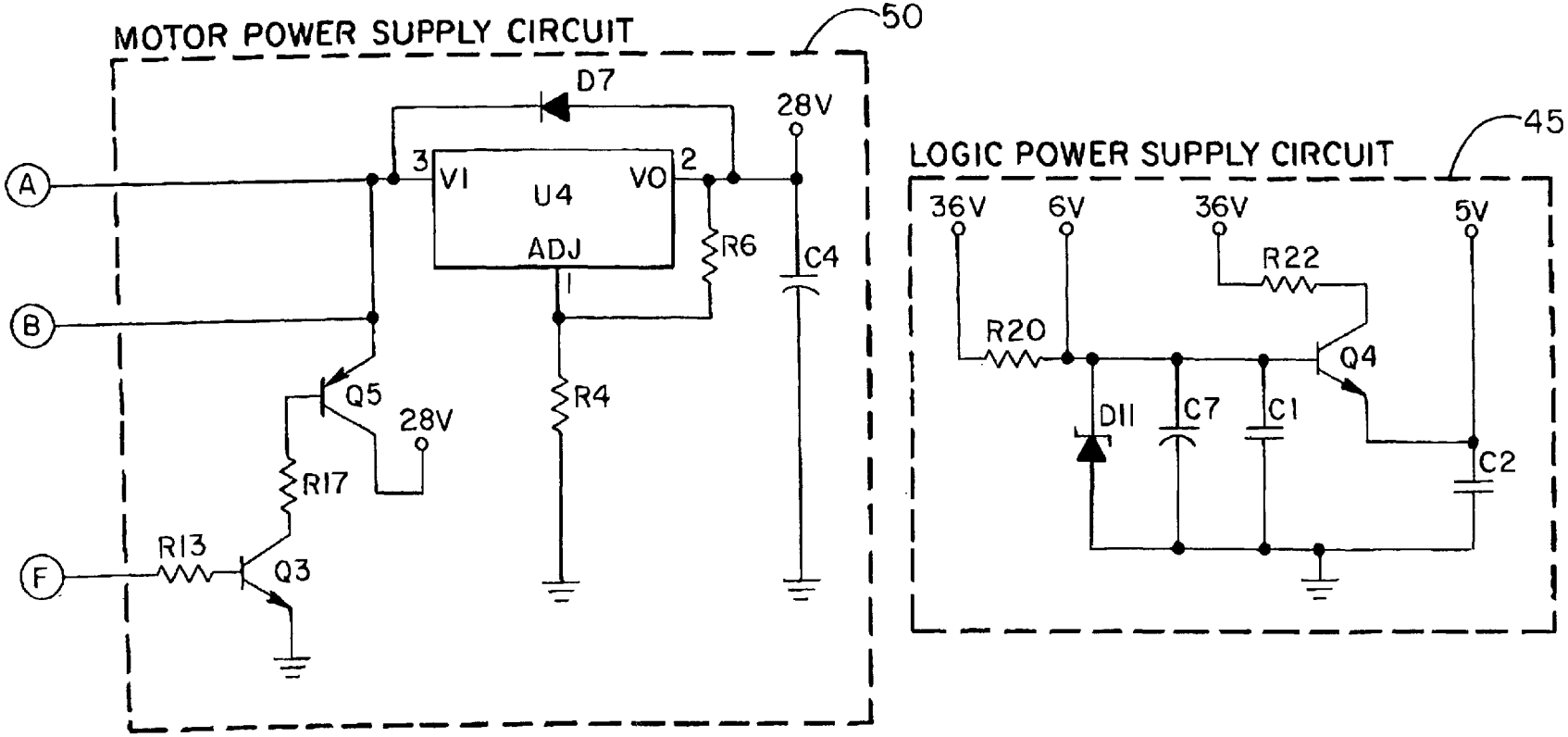

The electrical control unit 24 of the present invention is located within the dispenser 12 and serves to control the operation of motor 21 of pump 20, solenoid valve 15 and also senses the operation of dispense switch S. As better understood by reference to the schematic thereof, as represented in FIG. 2, control 24 includes an AC to DC and power relay circuit 30. Circuit 30 includes a full bridge having diodes D3–D6 and serves to convert a 26 VAC power source to 36 VDC power. A power relay R is used to supply the power to a motor power circuit for operating pump motor 21 and a control circuit relative to valve 15, as is discussed more fully herein below.

A microprocessor and memory circuit 35 includes a microprocessor U1 with a built in analog to digital converter having a clock speed is 4 MHz, for example, a model PIC16C711 processor as manufactured by MicroChip, of Chandler, Ariz. An external EEPROM U2 is used to store certain parameters used by microprocessor U1 in case of power down and initialization.

Control 24 also includes a pump motor current sensing circuit 40. The current draw of motor 21 is converted to a sample voltage signal via a 0.22 Ohm sampling resister R7. A dual operational amplifier U3 is used to amplify the sample voltage signal to the voltage level that is suitable for microprocessor U1 to read. An offset voltage is generated and adjustable by the output of microprocessor U1 to control the output of the voltage signal at a desired voltage level regardless the variations of the motor, tubing and other factors. A logic power supply circuit 45 includes a zener diode D11 to generate the power supply for the motor current sensing circuit 40. A transistor Q4 with a current limiting resister R22 are used to generate the power for microprocessor U1 and memory circuit 30.

A bypass transistor Q5 can provide an unregulated high voltage and high current to the motor for the initial start of the pump motor with a duration of 200 milliseconds.

An interface circuit 55 provides for a sold out output signal Q2 to drive an LED and dispense signal input. A valve driving circuit 60 includes a transistor Q6 to drive the solenoid(s) of valve 14 for dispense. Once a valve opens, a 50% duty cycle switch is applied at 250 HZ to the valve solenoid(s).

A better understanding of the operation of the present invention and particularly of the software control thereof can be had by reference to the flow diagram of FIG. 3. At the start block 100 the dispenser is powered up and awaits a dispensing cycle. At block 102, after pump motor 21 is running at a steady speed, detection circuit 40 samples the voltage once every 2 milliseconds and accumulates a data set over a span of 240 milliseconds. In the present case, the time period after which a steady state running speed occurs, for example one second, was experimentally determined for the particular motor being used. The data set is considered valid if the average of the 120 readings is above zero. At decision block 104 control 24 determines if the offset voltage must be adjusted. As will be understood by those of skill, the particular microprocessor used will have a certain voltage range that it can recognize or work with and there will be a variation of the current demand between dispensers. Thus, it can be necessary to adjust the initial average sensed voltage generally to a point in the middle of that range so that the subsequent sensed voltages high or low will remain within that range and be assigned an accurate relative value. Thus, if it is necessary to make such an adjustment, the magnitude thereof is calculated at block 106 and such adjustment made and stored into the EEPROM memory. Any further sampling during that dispense is ended at block 108 and the routine returns to start to wait for a subsequent dispense cycle. At block 110, the average voltage value of the last two valid data sets is calculated. At block 110 a compensating factor is added to that average value if the pump motor was run longer than 10 seconds for the current dispense. Thus, Block 110 represents an optional routine to compensate for the lower current draw that can occur as the result of heating if an electrical motor is run for a long enough time, i.e. the determined voltage is adjusted to take into account the erroneous voltage reading that can occur as a result of the heating. Those of skill will understand that such compensating factors are numbers that are experimentally determined and contained in look up tables in the software. At block 112, a stored reference value is compared with the just calculated voltage value. If that new value is larger than the stored reference value, the new value updates or replaces the old one. Thus, the routine herein can move to a higher value where the previous reference was too low. At block 114 the difference between the maximum and minimum voltage levels of the current dispense is calculated. If that value is greater than an experimentally determined empty threshold value then an empty flag is set at block 116. Thus, at block 114, if the difference between the high and low individual voltage readings of one dispense is great enough, that indicates a non-continuous stream of product being pumped, i.e. that the fluid is running out. A first empty threshold value is experimentally determined and included in the software routine for use at block 114 for determining a sold out condition. At block 118, the existing reference voltage value is compared with the currently determined value. If that difference is greater than a second predetermined sold out threshold value, then a sold out condition is also indicated, i.e., if the current value is very low in comparison to what would be expected if the container were full, no beverage fluid is being pumped and the container completely empty and must be changed out. If a sold out condition is indicated at block 118, a flag is also set at block 116. At block 120 it is determined if two flags have been set at block 116 during the current dispense. If that has not occurred, then at block 122, the average of the last 128 readings of the current and past dispensings is taken to update the voltage reference value for that which indicates a full container. This updated voltage reference value is also stored in the EEPROM. The routine then checks to see if the current dispense is finished at block 128. If not finished, the routine returns to block 102 to start another 240 ms duration sampling period. If finished, the sampling is stopped and the system returns to start block 100 to await a further dispense. If two sold out flags have been set during the current dispense, then at block 124, an empty status is indicated, and the current voltage reference value and the offset value for the full liquid level is recorded in the EEPROM. Then at block 126 the routine ends sampling of the current dispense. The empty status is indicated by the LED1 of FIG. 2B.

It can be appreciated that the above routine allows a variety of readings to trigger a sold out condition. Thus, where two consecutive "running out" events occur or where two consecutive "empty" events occur, or a combination thereof, a sold out condition will be indicated. Those of skill will understand that various motors and processors could be used wherein the numerical test data and the voltage range and the like will vary. In the present case a peristaltic type pump is used driven by a DC electric brush motor running around 240 rpm. One revolution is equal to approximately 0.24 second or 240 milliseconds. Thus, one valid data recording period equals approximately one full revolution which was determined to be long enough to generate a reliable data set. In a typical dispense, 10 to 16 sensing periods can be had.

What is claimed is:

1. A device for detecting an empty condition of a container of a liquid, the liquid being removed from the container by the operation of a motor driven pump during a dispense operation, the detecting device, comprising:

a control having a circuit for sensing a current demand of the motor, and the control operating to make a plurality of samplings of said motor current demand during a dispense operation, and the control indicating an empty condition of the container if the sensed current demand samplings are consistently less than a predetermined low current demand value and/or if the plurality of sampled motor current demands vary in that a maximum and a minimum of said sampled demands have a difference in value there between that exceeds a predetermined difference value.

2. A method for detecting an empty condition of a container of a liquid, the liquid being removed from the container by the operation of a motor driven pump during a dispense operation, the method comprising the steps of:

dispensing fluid from the container by initiating operation of the motor, making a plurality of samplings of a current demand of the motor, indicating an empty condition of the container if the sensed current demand samplings are consistently less than a predetermined low current demand value and/or, indicating an empty condition of the container if the plurality of sampled motor current demands vary in that a maximum and a minimum of said sampled demands have a difference in value there between that exceeds a predetermined difference value.

* * * * *